US009392860B2

(12) United States Patent
Redli

(10) Patent No.: US 9,392,860 B2
(45) Date of Patent: Jul. 19, 2016

(54) BACKPACK JACKET

(71) Applicant: Corbin J. Redli, Wyoming, MI (US)

(72) Inventor: Corbin J. Redli, Wyoming, MI (US)

( * ) Notice: Subject to any disclaimer, the term of this patent is extended or adjusted under 35 U.S.C. 154(b) by 7 days.

(21) Appl. No.: 14/204,358

(22) Filed: Mar. 11, 2014

(65) Prior Publication Data

US 2014/0263517 A1 Sep. 18, 2014

Related U.S. Application Data

(60) Provisional application No. 61/791,368, filed on Mar. 15, 2013, provisional application No. 61/898,117, filed on Oct. 31, 2013.

(51) Int. Cl.

| | |
|---|---|
| ***A45F 3/04*** | (2006.01) |
| ***A45F 4/12*** | (2006.01) |
| ***A41D 13/00*** | (2006.01) |
| *A45F 3/16* | (2006.01) |

(52) U.S. Cl.

CPC ..... *A45F 3/04* (2013.01); *A41D 13/0007* (2013.01); *A45F 4/12* (2013.01); *A45F 2003/166* (2013.01)

(58) Field of Classification Search

CPC ..... A45F 3/04; A45F 3/14; A45F 5/02; A45F 4/12; A45F 2003/166; A41D 15/00; A41D 13/0007

USPC ..... 2/69, 69.5, 70

See application file for complete search history.

(56) References Cited

U.S. PATENT DOCUMENTS

| | | | | |
|---|---|---|---|---|
| 2,165,348 | A | 7/1939 | Daiber | |
| 2,620,479 | A | 12/1952 | Buck | |
| 4,068,314 | A | 1/1978 | Yellen et al. | |
| 5,540,364 | A * | 7/1996 | Krieger | A45F 3/08 224/153 |
| 5,909,802 | A | 6/1999 | Puco et al. | |
| 6,029,270 | A | 2/2000 | Ost et al. | |
| 6,101,631 | A * | 8/2000 | Ferguson, Jr. | 2/94 |
| 7,000,255 | B1 | 2/2006 | Baacke | |
| 7,788,736 | B2 | 9/2010 | Gollin | |
| 8,091,151 | B2 * | 1/2012 | Johnson et al. | 2/455 |
| 8,776,266 | B1 * | 7/2014 | Metz | 2/94 |
| 2004/0244097 | A1 * | 12/2004 | Kassai | A41D 13/0007 2/310 |
| 2010/0282803 | A1 | 11/2010 | Simmons | |

FOREIGN PATENT DOCUMENTS

| | | |
|---|---|---|
| WO | 2005027678 | 3/2005 |

OTHER PUBLICATIONS

NF Powder Guide ABS Vest, www.backcountry.com.

Backcountry skiing airbag, Google search.

* cited by examiner

*Primary Examiner* — Corey Skurdal

(74) *Attorney, Agent, or Firm* — Mitchell Intellectual Property Law, PLLC

(57) ABSTRACT

A jacket includes an inner harness, a jacket for wearing over the harness, and a load for attachment to the harness through attachment openings in the jacket. The load can be an airbag, a backpack, or other load or load carrying member for attaching to the harness. The jacket has at least one back opening providing access to the inner harness, to facilitate the attachment of the load to the harness. The jacket can be readily removed without disturbing the harness or its load. The removed jacket is effectively carried by the load and/or harness to which the load is secured. The inner harness can be used to carry loads without using the jacket.

4 Claims, 8 Drawing Sheets

FIG. 2
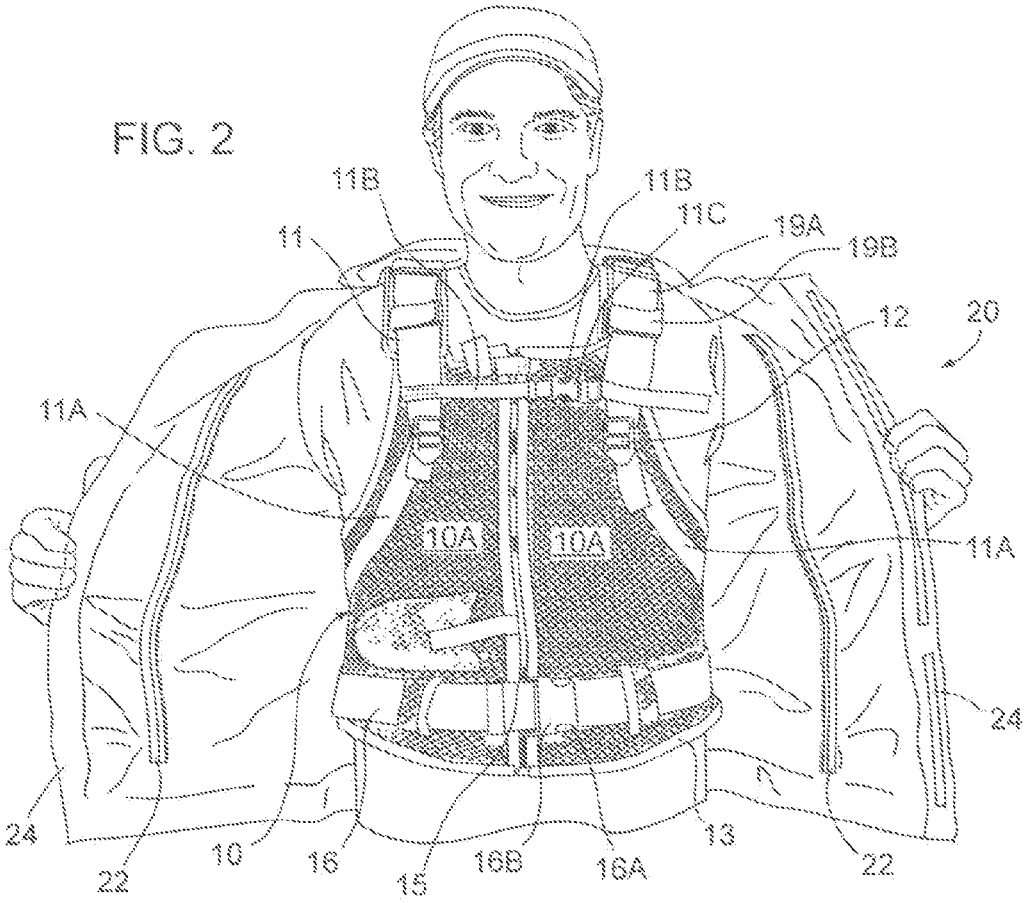
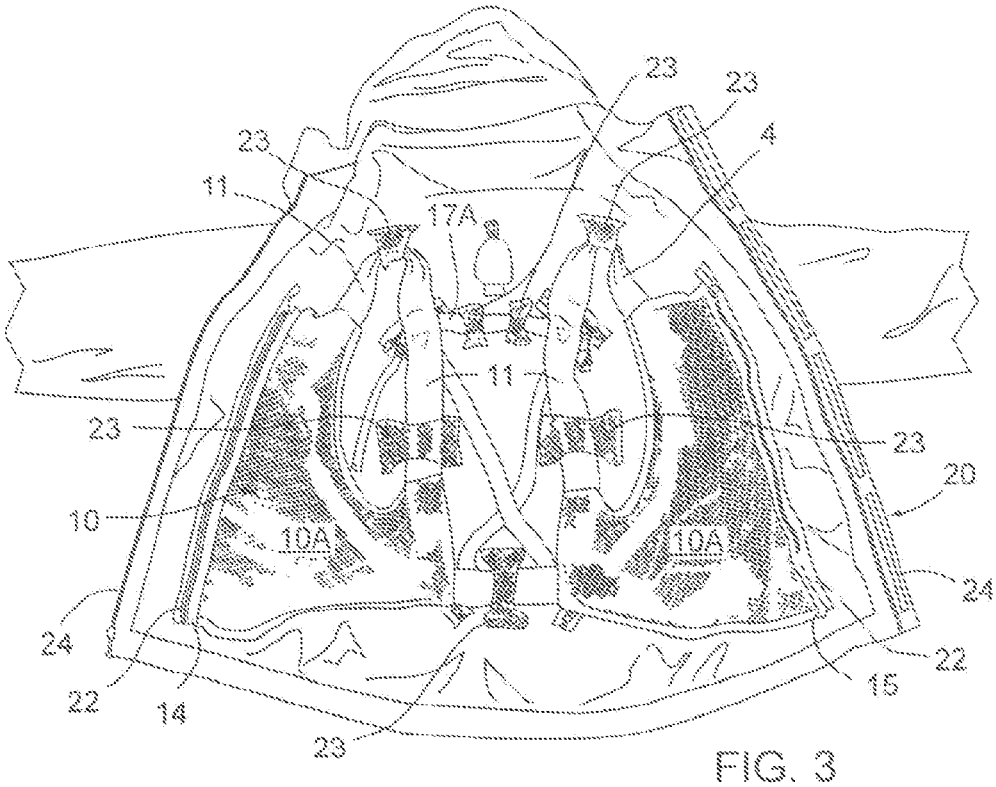
FIG. 3

BACKPACK JACKET

CROSS REFERENCE TO RELATED APPLICATION

This application claims priority to U.S. Provisional Application Ser. No. 61/791,368, filed Mar. 15, 2013, entitled BACKPACK JACKET, and U.S. Provisional Application Ser. No. 61/898,117, filed Oct. 31, 2013, entitled BACKPACK JACKET.

FIELD AND BACKGROUND OF THE INVENTION

The present invention relates to outdoor sporting gear, such as jackets and backpacks. Back-country skiing is an ever more popular recreational activity. Participants hike into remote areas of the mountains to ski fresh trails. Such activity requires that participants carry all their own gear long distances, including skis, food, water, and safety equipment, all while dressed for winter weather. Participants must either carry these items with them as they ski down the slope or leave them behind and retrieve them later. Typically, they wear a jacket for warmth, and carry their load in a backpack with straps which they slip over their arms and shoulders with their jackets on.

SUMMARY OF THE INVENTION

The backpack jacket of the present inventions allows a person to dress warmly in a jacket, carry skis, equipment, and other supplies on his or her back, switch loads without removing the jacket, and removing the jacket without removing the load. The present invention comprises an inner harness, a jacket for wearing over the harness, and a backpack or other load or load carrying member for attaching to the harness. The jacket has at least one back opening providing access to the inner harness, to facilitate the attachment of the load or load carrier to the harness. The jacket can be readily removed without disturbing the harness or its load. The removed jacket is effectively carried by the load and/or harness to which the load is secured.

These and other aspects, objects, features and advantages of the invention will be further understood and appreciated by reference to the written specification and appended drawings.

BRIEF DESCRIPTION OF THE DRAWINGS

FIG. 2 is a front-view of a preferred embodiment in use, with the jacket open to reveal the inner harness.

FIG. 3 is a front-view of a preferred embodiment jacket and harness, with both the harness and the jacket opened in front.

DETAILED DESCRIPTION OF THE PREFERRED EMBODIMENT

Figure 1:
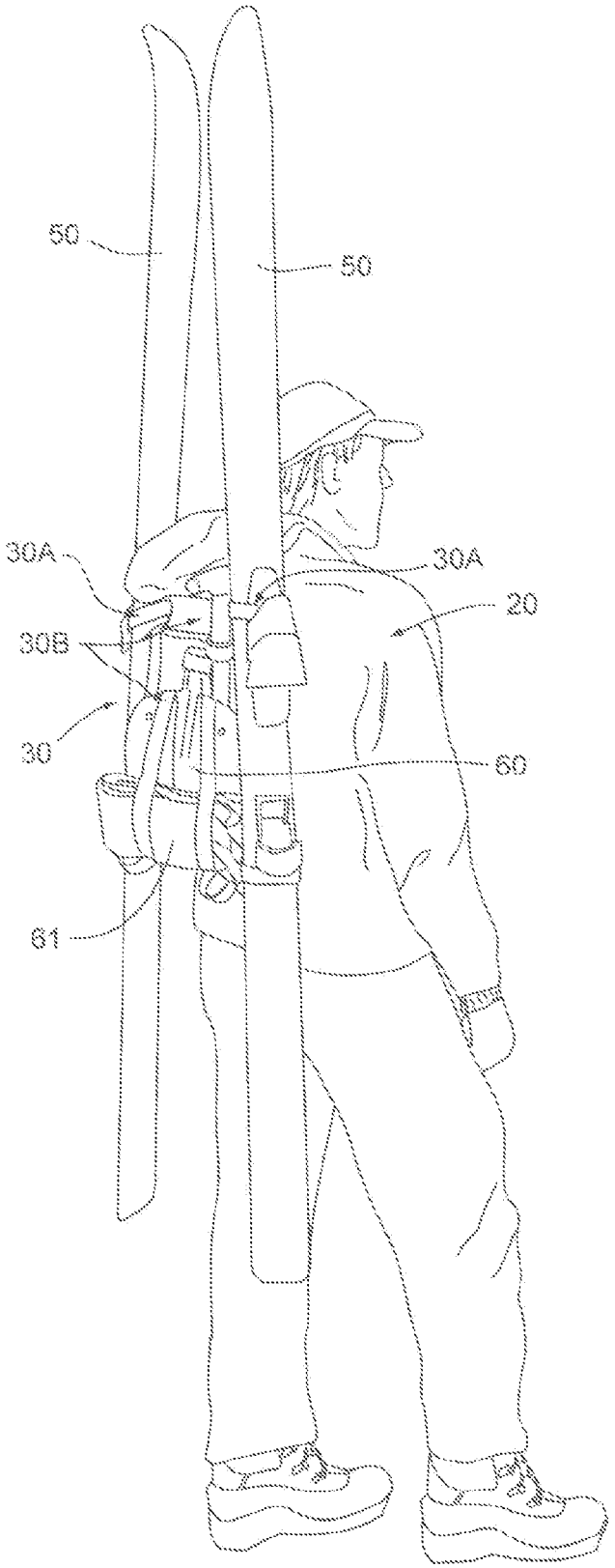
FIG. 1 is a three-quarter view of an embodiment of the present invention in use.

The preferred embodiment of the present invention comprises three main components: and inner harness 10, a jacket 20, and load carriers 30 (FIGS. 1, 2 and 3). In FIG. 1, the harness 10 is not visible. The load carriers 30 include ski straps 30A for carrying skis 50, and a safety gear pack 30B for carrying safety gear such as a shovel 60 and climbing aide 61.

The inner harness 10 (FIGS. 2 and 3) is preferably in the form of a vest, comprising woven straps 11, preferably nylon or similar material, breathable mesh panels 10A, fastener loops 18C to which load carrying members 30 can be attached, and zippers 15. The term harness 10 or harness vest 10 may be used interchangeably herein. At least two of the straps 11 form at least two shoulder loops through which the wearer can insert his or her arms (FIG. 2). Straps 11 are between 1 and 3 inches wide, preferably between 1.5 and 2.5 inches wide, and most preferably between 1.75 and 2.25 inches wide. The front portion 11A of each snap 11 is secured to its respective left or right front mesh panel 11 (FIG. 2). It continues around and under each arm opening, and on up the back side, where each strap 11 continues on past the mesh portion of the harness vest 10, over the shoulders, and back down to the front panel 10A, where an adjustment member 12 at the front of the harness vest 10 secures the strap ends together and allows a user to tighten straps 11 so that the harness vest 10 fits snugly. Preferably, an additional strap 11B is attached to the front of each straps 11, and attach to one another at the midpoint of the user's chest, preferably with a buckle 11C.

Edging material 13 is secured to mesh panels 10A, and defines the perimeter of harness vest 10. Edging 13 is at most 2 inches wide, preferably at most 1.5 inches wide, and most preferably less than 1 inch wide. Harness vest 10 is fastened in the front by a zipper 15, each half of which is secured to the vertical edge of its respective front panel 10A. Zipper 15 is of a length such that when the harness vest 10 is unfastened in front, each half of zipper 15 can be zipped into an interior zipper 22A or 22B, respectively, of the jacket 20 (compare FIGS. 2 and 3).

Figure 4:
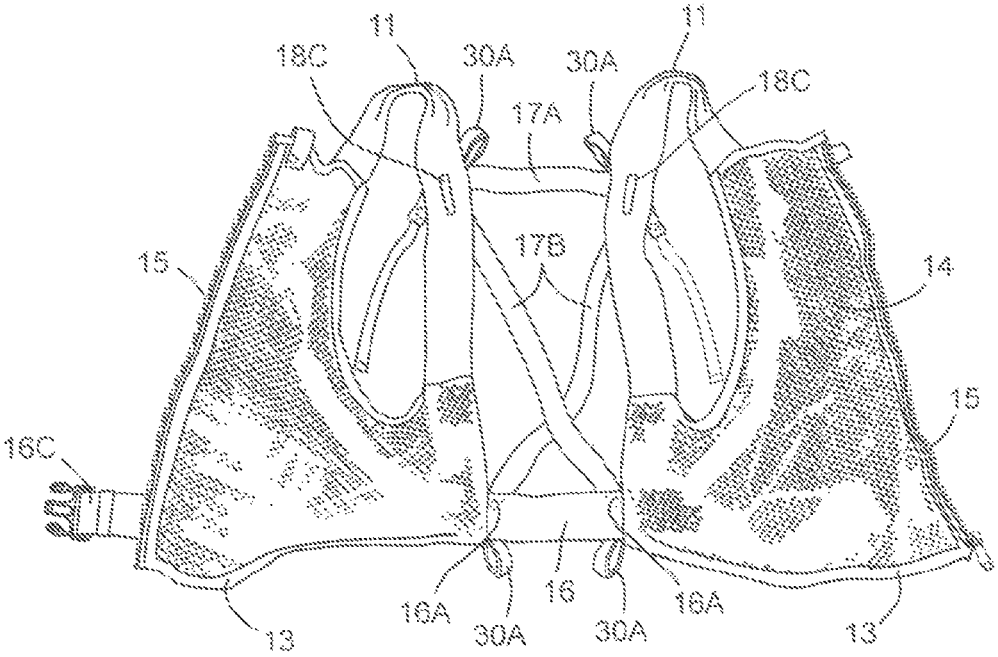
FIG. 4 is a front view of the harness detached from the jacket.
Figure 5:
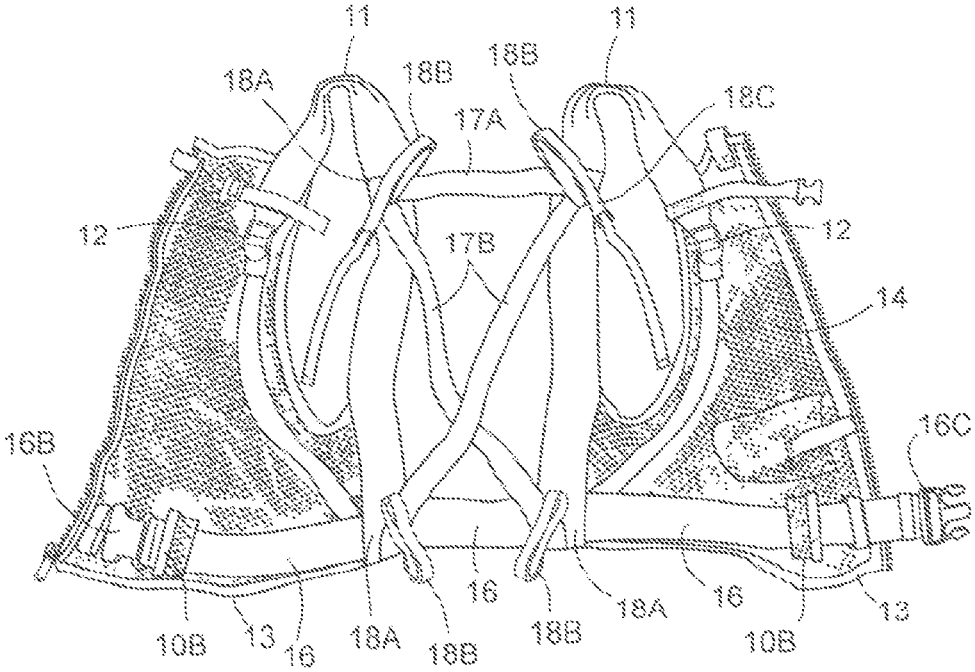
FIG. 5 is a rear view of the harness detached from the jacket.

Straps 11 come over a user's shoulders, and continue down a user's back, where they join the back of mesh panels 10A, and further are connected at their base to a waist encompassing belt 16 (FIGS. 4 and 5). Belt 16 is secured in part to mesh panels 10A, but are free towards their ends. Thus the ends of belt 16 pass through loops 10B to ends which terminate at mating buckles 16A and 16B. Straps 11 are connected at the back of the wearer by reinforcement strap 17A. At least two straps 17B form an "x" between the intersecting points of straps 11 and reinforcement strap 17A at the top, and the intersecting point of straps 11 and belt 16, forming a total of at least four intersection points 18A.

The at least four intersection points 18A are reinforced with additional strap material, preferably nylon. Attached to each of said reinforced points 18A is at least one load carrying ski-strap 30A. Ski-strap 30A may be fastened into a loop to hold a ski or disengaged to remove the skis. Preferably, the fastening member is a hook and loop fabric connector, such as Velcro™, and most preferably with industrial grade version of such a product. Each ski-strap 30A is between 0.25 and 1.5 inches wide, preferably between 0.50 and 1 inches wide. Preferably, each ski-strap 30A is positioned on harness vest 10 such that it can be reached by a user and disengaged without removing the harness vest 18 or jacket 20.

Figure 7A:
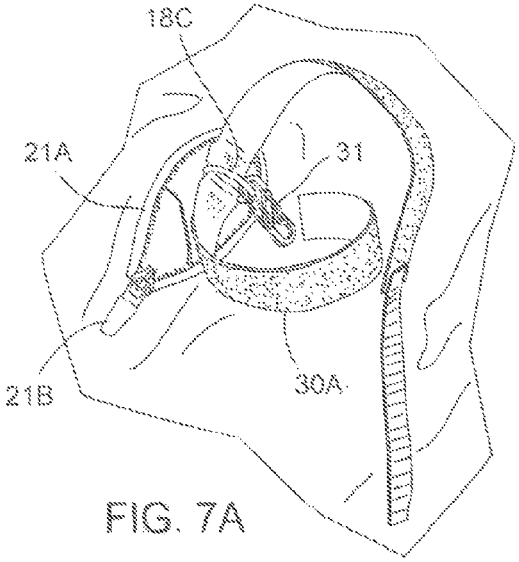
FIG. 7A is a close-up view of a portion of the back of the jacket, showing the inner harness access opening, load attachment loops and ski-carrying straps.
Figure 8:
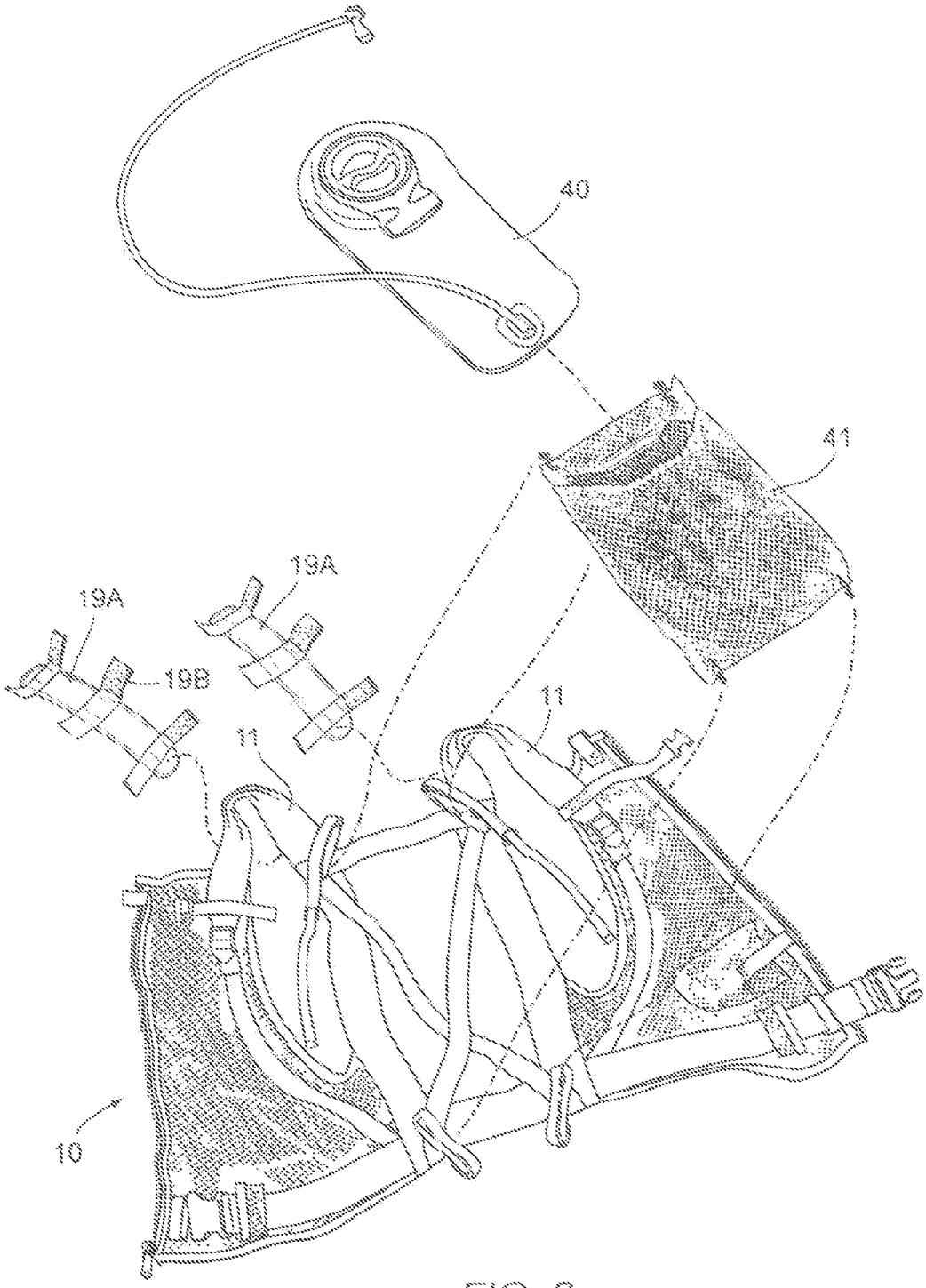
FIG. 8 is an exploded view of the harness of the present invention.
Figure 9:
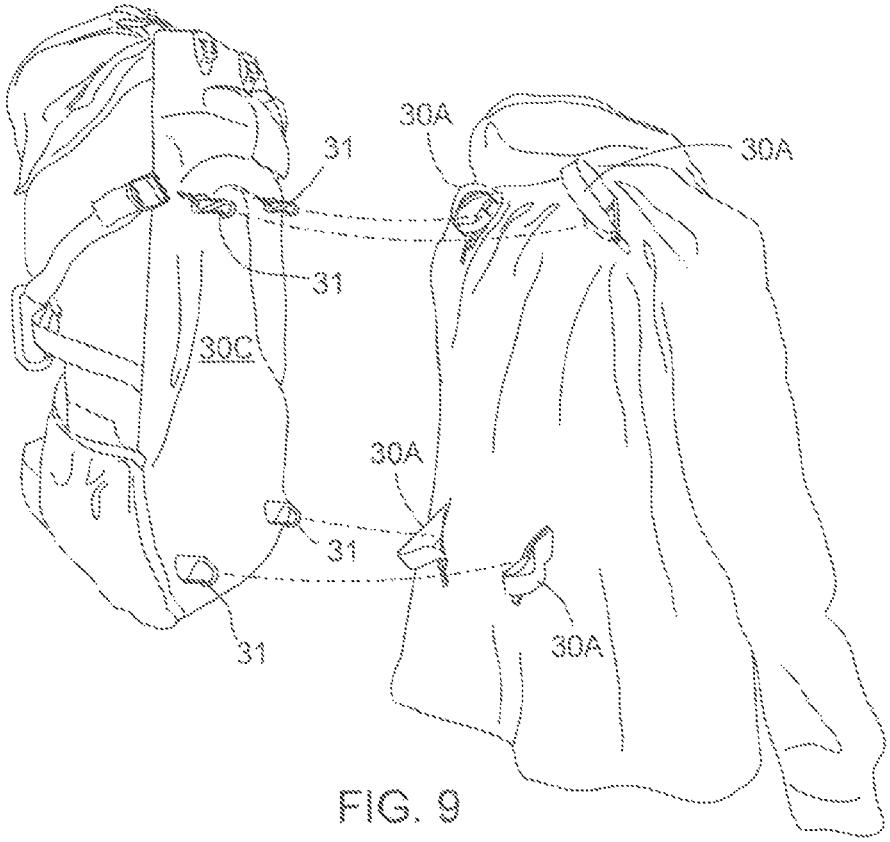
FIG. 9 is a perspective view of a backpack being secured to the harness through the harness access openings in the back of the jacket.
Figure 10:
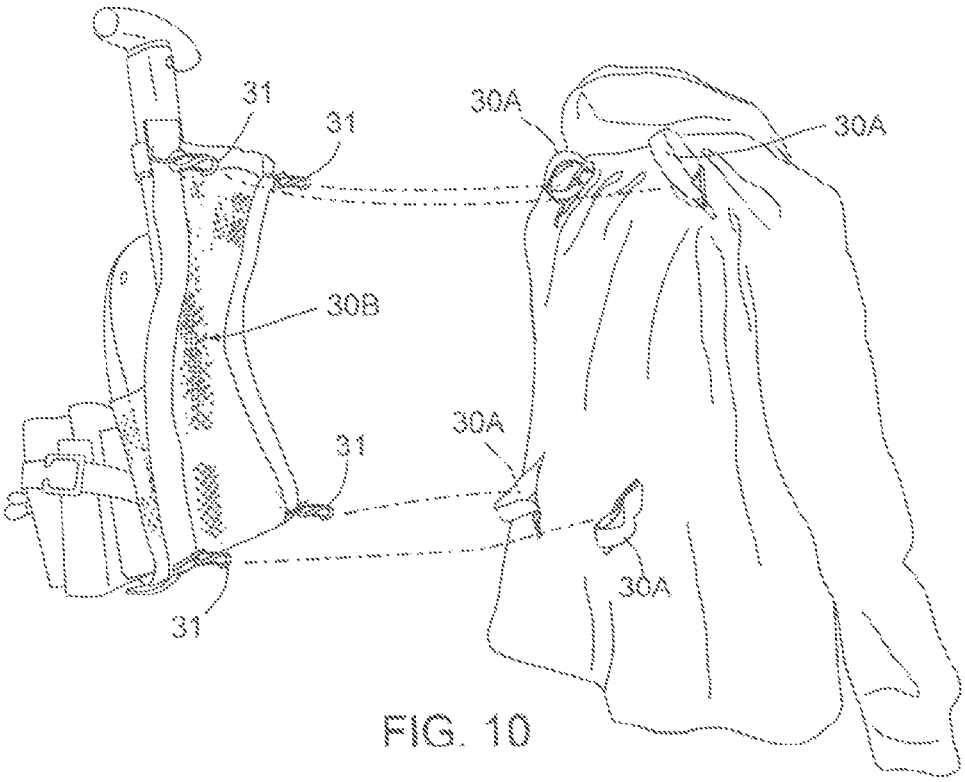
FIG. 10 is a perspective view of a safety gear pack being secured to the harness through the harness access openings in the back of the jacket.

Also attached to said reinforced intersection points 18A are loops 18C for securing loads to harness 10. Loops 18C can be engaged by a clip 31 of a load carrying member such as backpack 30C or safety pack 30B (FIGS. 7A, 9 and 10). Straps 11 of harness 10 include detachable pads 19A (FIG. 8). Pads 19A cushion harness 10 against the wearer's body. Pads 19A are between 4 and 10 inches long, preferably 5 and 8, and conform to the width of straps 11. Pads 19A are attached by wrapping a fastening member 19B around straps 11 and can be removed when the harness vest 10 is zipped inside jacket 20.

An optional water bladder 40 and mesh carrier 41 therefor can be removably secured to harness vest 10 (FIG. 8). Mesh carrier 41 is equipped with at least one clip 31, such that mesh carrier 41 can be secured to loops 18C (FIG. 7A). By positioning mesh carrier 41 between harness vest 10 and jacket 20, optional water bladder 40 can be carried inside jacket 20, allowing the user's body heat to keep the water from freezing while having the additional advantage of freeing the outside of jacket 20 for additional load carriers 30.

In the preferred embodiment, jacket 20 is made of nylon or other water-repellant material. Jacket 20 contains at half of a zipper 22 running vertically on the interior face of the front of the jacket, spaced inwardly from the jacket's closure zipper halves 24 (FIGS. 2 and 3). Each zipper half 22 corresponds in length to each zipper half 15 of vest 10. The zipper halves are attached such that the slider end of interior jacket zipper 22 lines up with the non-slider half of the vest zipper 15, and the slider end of the vest zipper 15, lines up with the non-slider half of the interior jacket zipper 22.

Figure 6:
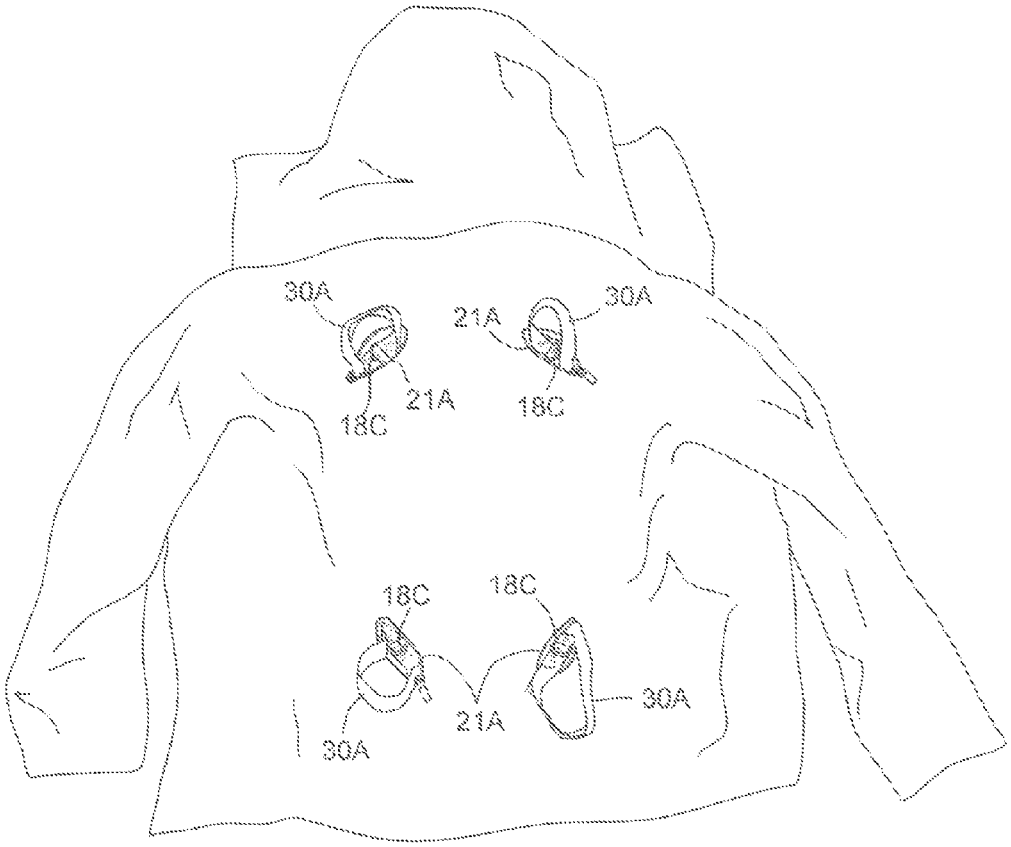
FIG. 6 is a rear view of the jacket with attached harness, showing the harness load attaching loops accessible through openings in the back of the jacket, and ski carrying straps secured to the load attaching loops.
Figure 7B:
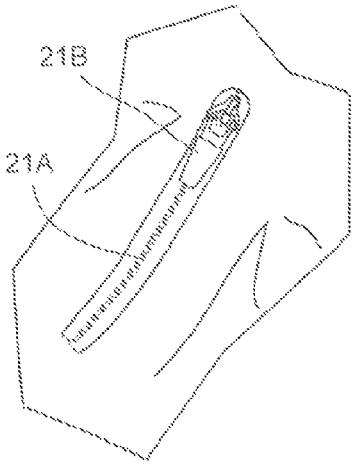
FIG. 7B is close up view of the same portion of the back of the jacket as in FIG. 7A, but with the harness access opening zipped closed.

Jacket 20 has four openings 21A in its back panel (FIGS. 6, 7A and 7B). Openings 21A are preferably closeable openings, as for example using zippers 21B (as shown in FIGS. 7A and 7B). Openings 21A permit access to load-carrier attachment loops 18C of harness 10. Yet openings 21A can be closed (FIG. 7B) when there is no load to be carried. Jacket 20 thus can function as a conventional jacket, if desired. As shown in FIGS. 9 and 10, load-carriers 30A, 30B and/or 30C may be attached to the inner harness 10 by passing straps through attachment loops 18C as in the case of ski straps 30A, or by securing clips 31 to attachment loops 18C, in the case of backpack 30B or safety pack 30C. Different load-carriers may be interchangeably attached to the harness. In some cases two and possibly more load carrying devices may be secured to inner harness 10 via attachment loops 18C, as for example the simultaneous use of ski straps 30A and either a backpack 30B or an avalanche safety pack 30B.

Load-carriers including, but not limited to, backpacks 30C, avalanche safety kits 30B, beverage carriers, and sleds are contemplated in the invention. Other types of load carriers not shown are within the contemplation of the invention. The location of the attachment loops 18C on the inner harness 10 are such that the user, by tightening the adjustment straps 11 on harness 10, can cause the load-carrier 30 to fit snugly against his or her back, allowing the user to carry equipment with him or her as he or she skis without discomfort.

Harness 10 can be attached to the interior of jacket 20 in a number of ways without departing from the spirit of the invention. In a preferred embodiment, straps 11, reinforcing strap 17A and belt 16 can be passed through nylon loops 23 sewn to the lining of jacket 20. In this way, the jacket and harness 10 may move independently of each other, while remaining attached. A user can remove jacket 20 and drape it over the load-carrier, allowing the user to regulate his or her temperature while still carrying a load and without leaving a jacket behind. Jacket 20 can be worn solely as a jacket, either with harness 10 inside it, or without harness 10 altogether. Harness 10 can be worn with an attached load, without jacket 20 altogether, though it is more preferable to carry the removed jacket as part of the load, with attachment of the load being through the openings 21A in the back of jacket 20. One can thus take off or place jacket 20 back on, without having to remove or disturb load 30.

Figure 11:
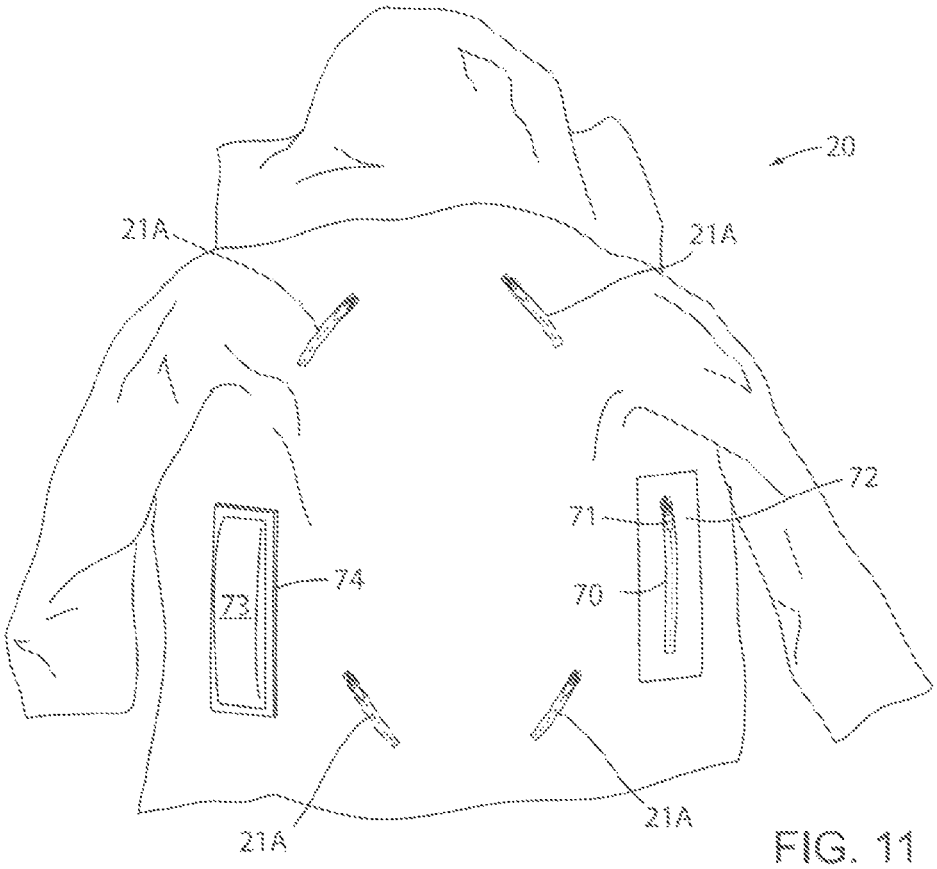
FIG. 11 is a rear view of the jacket as equipped for the airbag feature, with and without the airbag attached.
Figure 12:
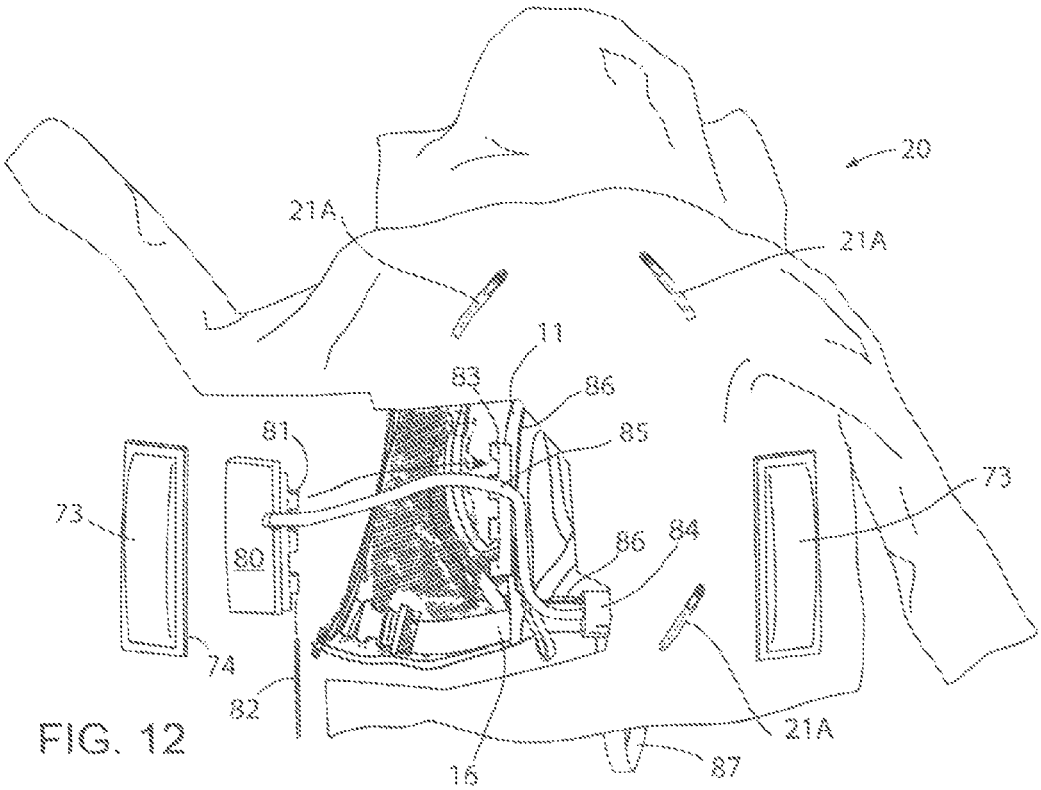
FIG. 12 is an exploded rear view of the jacket, showing the airbag attachments through the jacket.

The jacket 20 is also equipped for use with an inflatable airbag or airbags 80. (FIGS. 11-13) The rear of jacket 20 has additional openings 70 which are separate from the openings 21A for the fastener loops 18C and ski straps 30A (FIG. 11). To access inner harness 10 through openings 70 in the jacket 20, there is a zipper 71 for each opening 70. Surrounding the opening 70 is a panel 72 of the loop side of a hook and loop closure. The right side of FIG. 11 depicts this opening in its closed position without anything attached. The left side of the figure depicts the jacket with the airbag 80 installed, though hidden under a weather proof cover panel 73, which attaches to the loop material of panel 72 via a mating hook surface 74 on the underside of panel 73.

Figure 13:
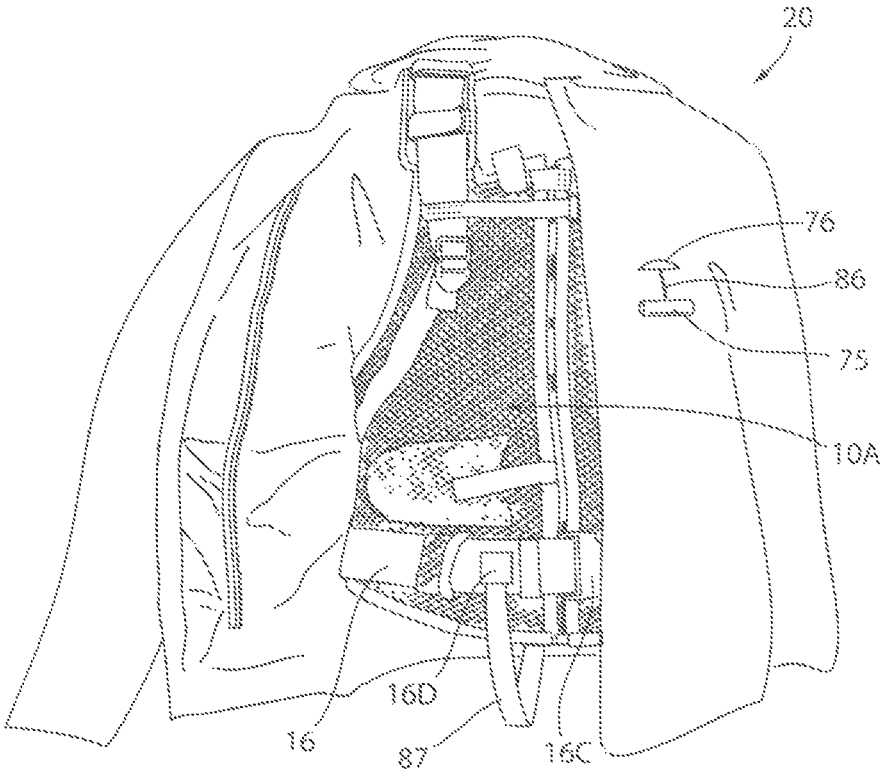
FIG. 13 is a front view of the jacket and inner harness including features for use with the airbag attachments.

Airbag 80 is installed via webbing straps 81 that are attached to the airbag 80, which mate with webbing straps 83 that are affixed to vertical strap 11 of inner harness 10, and an attachment pin 82 which slides through inter-leaving loops in both sets of webbing straps 81 and 83. An air line 85 connects the airbag 80 to the pressurized air chamber or air pump 84 secured to belt strap 16 near the rear center thereof. To activate the airbag 80, the user pulls a handle 75 that protrudes through an overlapping opening 76 in the front of jacket 20 (FIG. 13). Pulling on handle 75 activates the pressurized air chamber or air pump 84 via the activation line 86 and the compressed or pumped air leaves air chamber 84 via air line 85 and inflates airbag 80.

When installed, the airbag 80 remains on the outside of jacket 20 and only webbing straps 81 penetrate openings 70. Airbag 80 and openings 70 are covered and made weather tight by a weather proof cover 73, preferably made of Gor-Tex® or some other such material. The hook surface 74 of weather proof cover 73 may be an attached panel of the hook side of a hook and loop closure. Hook surface 74 on the weather proof cover 73 mates with the loop panel 72 on the jacket 20 to seal airbag 80 in place against the exterior of jacket 20. When airbag 80 is activated, the panels 72 and 73 separate and airbag 80 deploys to the outside of the jacket 20. To make certain that air bags 80 are held in proper orientation on the body of the user when inflated, inner harness 10 includes a pelvic strap 87, attaches to the belt 16 near the center back of belt 16, and wraps snugly around between the users legs of the user and attaches to the belt 16 at the front, as for example via a buckle 16D located near buckle 16C.

As with other loads which can be attached to harness 10, air bags 80 and harness 10 can be used without the jacket portion 20. Similarly, jacket 20 can be removed with air bags 80 in place, and draped over the attachments to air bags 80 and any other load which may be attached to harness 10.

The forgoing are preferred embodiments of the invention, and various changes and alterations can be made within the scope of the invention as set forth in the appended claims.

The invention claimed is:

1. A jacket and load carrier combination comprising: a harness adapted to be worn on a user's torso, and having a back portion located on the user's back when said harness is worn; said harness including at least one fastener member op said back portion to which a load carrier can be releasably attached; a jacket for wearing over said harness; a load carrier for attaching to said harness, said load carrier including at least one fastener which releasably attaches to said fastener member on said harness; said jacket having a back and at least one opening in said back of said jacket providing access to said fastener member on said harness, to facilitate the attachment of said load carrier fastener to said harness fastener member; said harness and said jacket being separate and independent articles, whereby they can be worn independently of each other, or together, or when said jacket is being worn over said harness with a load carrier attached to said harness, said jacket can be removed from the user without being separated from said harness, and carried on the user's back by said harness, said harness is in the form of a vest, comprising two mesh front members attached to strap members, said strap members including at least two shoulder loop members, said shoulder loop members forming openings for insertion of a user's arms into said vest, said strap members further include a belt member positioned near the user's waist; said shoulder loop members have a base portion which will be located below a user's arm when said vest is worn, and said belt member is attached to said shoulder loop members at said base portion of said shoulder loop members, defining a point of intersection between each said shoulder loop member and said belt member; said strap members further comprise a reinforcing shoulder strap connecting said shoulder loop members at the back of a user's shoulders, and defining points of intersection between said shoulder strap and said shoulder loop members; wherein said strap members further comprise at least two crossing reinforcing back straps, each said reinforcing back strap connecting said point of intersection between said belt member and said shoulder loop member and connecting with said point of intersection between said reinforcing shoulder strap and said shoulder loop members at the back of the user's shoulders.

2. A jacket and load carrier combination comprising: a harness adapted to be worn on a user's torso, and having a back portion located on the user's back when said harness is worn; said harness including at least one fastener member on said back portion to which a load carrier can be releasably attached; a jacket for wearing over said harness; a load carrier for attaching to said harness said load carrier including at least one fastener which releasablv attaches to said fastener member on said harness; said jacket having a back and at least one ( )aint in said back of said jacket providing access to said fastener member on said harness, to facilitate the attachment of said load carrier fastener to said harness fastener; said harness and said jacket being separate and independent articles,whereby they can be worn independently of each other, or together, or when said jacket is being worn over said harness with a load carrier attached to said harness, said jacket can be removed from the user without being separated from said harness, and carried on the user's back by said harness; wherein there are two of said openings in the back of said jacket, said harness having at least two ski holders, that can be extended through said openings in said jacket to facilitate carrying skis; there also being two of said fasteners on said harness, each said fastener being, adjacent one of said ski holders, whereby each of said ski holders and its adjacent one of said fasteners can be accessed through the same one of said openings in said back of said jacket.

3. A jacket and load carrier combination comprising: a harness having a load carrier comprising at least four ski holders thereon; a jacket for wearing over said harness, said jacket having a back and at least four openings in said back of said jacket, each adjacent one of said ski holders, thereby providing access to said ski holders such that they can be pulled through said openings for carrying skis; each said ski holder comprising a loop including a releasable fastener such that each loop can be opened or closed to facilitate loading or unloading skis; said harness and said jacket being separate and independent articles, whereby they can be worn independently of each other, or together. or when said jacket is being worn over said harness with skis carried in said ski holders, and said jacket can be removed from the user without being separated from said harness, and carried on the user's back by said harness.

4. A method for enabling a person to carry skis in addition to another load when pursuing outdoor activities such as skiing, camping, hiking or the like, comprising:

providing a harness adapted to be worn on a user's torso, and having a back portion located on the user's back when said harness is worn; said harness including at least one fastener member on said back. portion to which a load carrier can be releasably attached;

providing said back portion of said harness with at least first and second spaced apart ski holders, said first of which may be adjacent said at least one fastener member;

providing a jacket for wearing over said harness;

providing a load carrier for attaching to said harness, said load carrier including at least one fastener which releasably attaches to said fastener member on said harness;

providing in said jacket at least two spaced apart openings in the back of said jacket, one located to provide access to said fastener member on said harness, and to said first one of said ski holders if it is positioned adjacent said fastener, and the other of said openings best located to provide access to said second ski holder, and if said first ski holder is not positioned adjacent said fastener, providing in said back of said jacket at least a third opening spaced apart from said at least two openings, located to provide access to said first ski holder;

said openings in said back of said jacket facilitating the attachment of said load carrier fastener to said harness fastener member, and facilitating access to said ski holders, whereby said ski holders can be pulled through said openings when it is desired to attach skis thereto;

said harness and said jacket being separate and independent articles, whereby they can be worn independently of each other, or together, or when said jacket is being worn over said harness with a load carrier attached to said harness, and/or skis attached to said ski holders, said jacket can be removed from the user without being separated from said harness, and carried on the user's back by said harness and said load carrier and/or said ski holders with attached skis.

* * * * *